US006720924B2

(12) United States Patent
Tomomatsu et al.

(10) Patent No.: US 6,720,924 B2
(45) Date of Patent: Apr. 13, 2004

(54) ANTENNA APPARATUS

(75) Inventors: Isao Tomomatsu, Tokyo (JP); Takahiro Ueno, Tokyo (JP); Toshiyuki Imagawa, Tokyo (JP); Minoru Oozeki, Tokyo (JP); Masayuki Ishiwa, Tokyo (JP)

(73) Assignees: The Furukawa Electric Co., Ltd., Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 10/067,439

(22) Filed: Feb. 5, 2002

(65) Prior Publication Data

US 2002/0149538 A1 Oct. 17, 2002

(30) Foreign Application Priority Data

Feb. 7, 2001 (JP) ..... 2001-030956
Feb. 7, 2001 (JP) ..... 2001-030957
Feb. 7, 2001 (JP) ..... 2001-030958

(51) Int. Cl.[7] ..... H01Q 1/38; H01Q 1/24
(52) U.S. Cl. ..... 343/700 MS; 343/702; 343/895
(58) Field of Search ..... 343/702, 700 MS, 343/895, 873; H01Q 1/38, 1/24, 1/36

(56) References Cited

U.S. PATENT DOCUMENTS

| | | | | |
|---|---|---|---|---|
| 4,381,566 A | | 4/1983 | Kane | |
| 4,742,359 A | * | 5/1988 | Ishino et al. | 343/895 |
| 5,087,920 A | | 2/1992 | Tsurumaru et al. | |
| 5,448,250 A | | 9/1995 | Day | |
| 5,559,524 A | | 9/1996 | Takei et al. | |
| 5,892,480 A | | 4/1999 | Killen | |
| 5,892,490 A | | 4/1999 | Asakura et al. | |
| 5,898,413 A | | 4/1999 | Mandai et al. | |
| 5,973,651 A | | 10/1999 | Suesada et al. | |
| 6,075,491 A | | 6/2000 | Dakeya et al. | |
| 6,112,102 A | | 8/2000 | Zhinong | |
| 6,133,880 A | | 10/2000 | Grangeat et al. | |
| 6,172,655 B1 | * | 1/2001 | Volman | 343/895 |
| 6,304,220 B1 | | 10/2001 | Herve et al. | |
| 6,320,545 B1 | | 11/2001 | Nagumo et al. | |
| 6,323,811 B1 | | 11/2001 | Tsubaki et al. | |
| 6,359,589 B1 | | 3/2002 | Bae | |
| 6,380,895 B1 | | 4/2002 | Moren et al. | |
| 6,388,626 B1 | | 5/2002 | Gamalielsson et al. | |
| 2002/0027530 A1 | | 3/2002 | Tomomatsu et al. | |
| 2002/0075186 A1 | | 6/2002 | Hamada et al. | |
| 2002/0080076 A1 | | 6/2002 | Kamei et al. | |

FOREIGN PATENT DOCUMENTS

| | | |
|---|---|---|
| CA | 2310682 | 12/2000 |
| EP | 0 762 539 A1 | 3/1997 |
| EP | 0 893 841 A1 | 1/1999 |
| EP | 1 120 855 A2 | 8/2001 |
| EP | 1 291 963 A1 | 3/2003 |
| JP | 2000-59125 | 2/2000 |
| JP | 2001-68917 | 3/2001 |
| WO | WO 96/27219 | 9/1996 |
| WO | WO 96/38882 | 12/1996 |
| WO | WO 01/08258 A1 | 2/2001 |

OTHER PUBLICATIONS

European Search Report issued by the European Patent Office on May 3, 2002 for Application No. EP 02 00 2028.

* cited by examiner

*Primary Examiner*—Hoanganh Le
(74) *Attorney, Agent, or Firm*—Knobbe Martens Olson & Bear LLP

(57) ABSTRACT

An antenna apparatus comprises a substrate, a chip antenna mounted on the substrate, and a ground pattern disposed on the substrate, at least a portion on the side of a power supply terminal of an antenna conductor in the chip antenna being overlapped with the ground pattern.

9 Claims, 18 Drawing Sheets

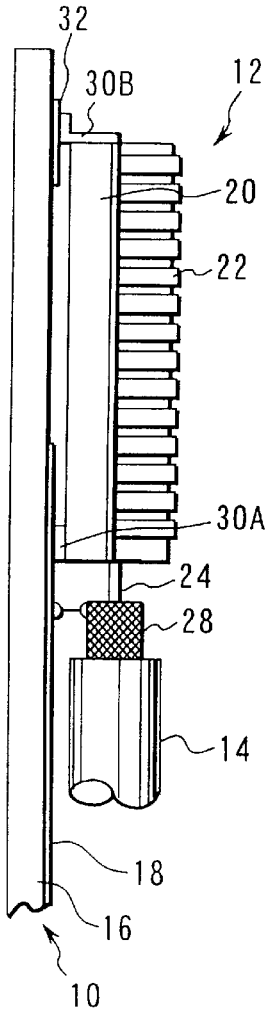
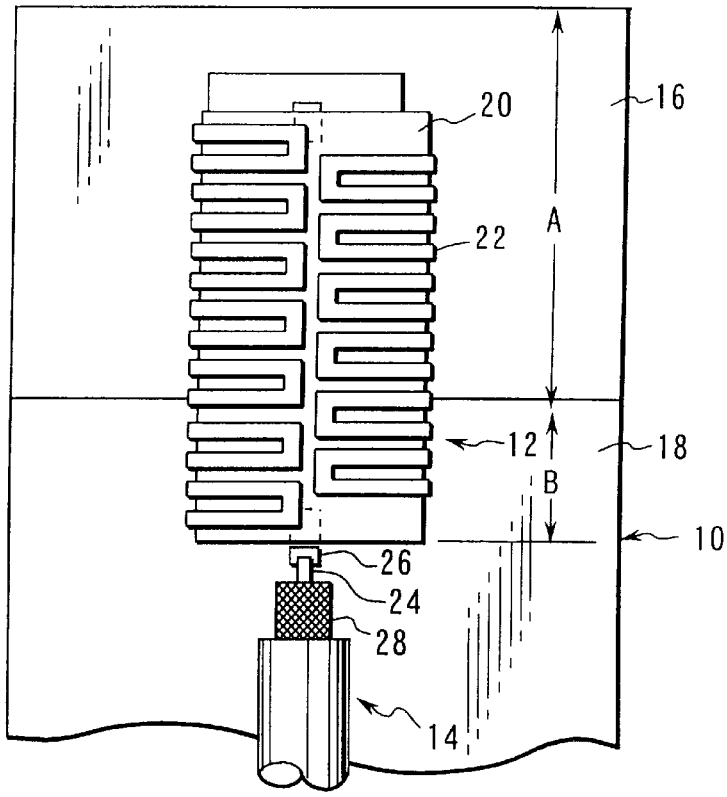
FIG. 9A
FIG. 9B

ANTENNA APPARATUS

CROSS-REFERENCE TO RELATED APPLICATIONS

This application is based upon and claims the benefit of priority from the prior Japanese Patent Applications No. 2001-030956, filed Feb. 7, 2001, No. 2001-030957, filed Feb. 7, 2001; and No. 2001-030958, Feb. 7, 2001, the entire contents of all of which are incorporated herein by reference.

BACKGROUND OF THE INVENTION

1. Field of the Invention

The present invention relates to an antenna apparatus used for small sized communication equipment such as a mobile phone.

2. Description of the Related Art

Conventionally, to downsize a mobile phone or the like, an antenna apparatus mounting a surface mount type chip antenna on a printed circuit board is known.

In order to downsize the communication equipment, it is necessary to downsize the chip antenna as small as possible. However, there is a problem that, a bandwidth of an antenna is narrowed by downsizing the chip antenna.

BRIEF SUMMARY OF THE INVENTION

It is an object of the present invention to provide an antenna apparatus whose size is smaller and whose bandwidth is wide.

An antenna apparatus according to the present invention is characterized by comprising: a substrate; a chip antenna mounted on the substrate; and a ground pattern disposed on the substrate, at least a portion on the side of a power supply terminal of an antenna conductor in the chip antenna being overlapped with the ground pattern.

With such a configuration, the size of the substrate can be reduced by the overlapped size of the chip antenna and the ground pattern side, and the matching of the chip antenna and power supply line can be easily obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 1A and FIG. 1B are views each showing an antenna apparatus according to a first embodiment of the present invention, wherein FIG. 1A is a front view of the antenna apparatus, and FIG. 1B is a side view of the antenna apparatus;

FIG. 5A and FIG. 5B are views each showing an example of a conventional antenna apparatus, wherein FIG. 5A is a front view of the conventional antenna apparatus, and FIG. 5B is a side view of the conventional antenna apparatus;

FIG. 6A and FIG. 6B are views each showing an antenna apparatus according to a second embodiment of the present invention, wherein FIG. 6A is a front view of the antenna apparatus, and FIG. 6B is a side view of the antenna apparatus;

FIG. 9A and FIG. 9B are views each showing an antenna apparatus according to a third embodiment of the present invention, wherein FIG. 9A is a front view of the antenna apparatus, and FIG. 9B is a side view of the antenna apparatus;

FIG. 12A and FIG. 12B are views each showing an antenna apparatus according to a fourth embodiment of the present invention, wherein FIG. 12A is a front view of the antenna apparatus, and FIG. 12B is a side view of the antenna apparatus;

FIG. 13A and FIG. 13B are views each showing an antenna apparatus according to a fifth embodiment of the present invention, wherein FIG. 13A is a front view of the antenna apparatus, and FIG. 12B is a side view of the antenna apparatus;

FIG. 14A and FIG. 14B are views each showing a chip antenna of an antenna apparatus according to a sixth embodiment of the present invention, wherein FIG. 14A is a perspective view of the antenna apparatus, and FIG. 14B is a sectional view of the antenna apparatus;

FIG. 15A and FIG. 15B are views each showing a state in which performance of a chip antenna is tested, wherein FIG. 15A is a front view of the chip antenna, and FIG. 15B is a side view of the chip antenna;

FIG. 16A and FIG. 16B are views each showing a chip antenna of an antenna apparatus according to a seventh embodiment of the present invention, wherein FIG. 16A is a perspective view of the antenna apparatus, and FIG. 16B is a sectional of the antenna apparatus;

FIG. 21A and FIG. 21B are views each showing a chip antenna used for the antenna apparatus shown in FIG. 17A and FIG. 17B, wherein FIG. 21A is a perspective view of the chip antenna, and FIG. 21B is a sectional view of the chip antenna; and FIG. 22A to FIG. 22C are views each showing a modified example of a chip antenna used for an antenna apparatus according to an eighth embodiment of the present invention, wherein FIG. 22A is a plan view of the antenna apparatus, FIG. 22B is a front view of the antenna apparatus, and FIG. 22C is a bottom view of the antenna apparatus.

DETAILED DESCRIPTION OF THE INVENTION

Hereinafter, embodiments of the present invention will be described in detail with reference to the accompanying drawings.

(First Embodiment)

Figure 1B:
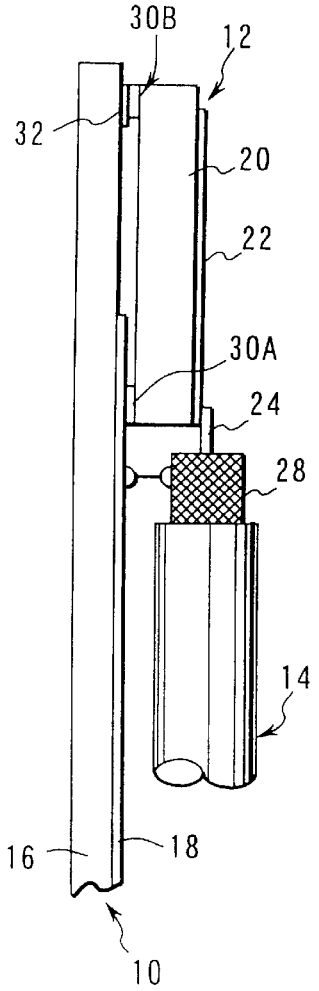
Figure 1A:
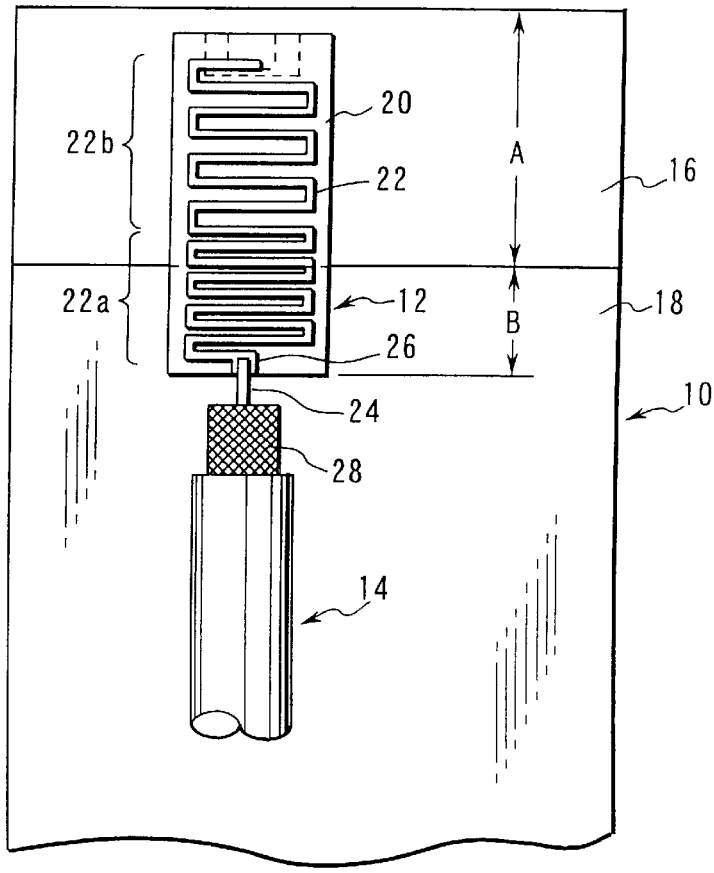

FIG. 1A and FIG. 1B are views each showing an antenna apparatus according to a first embodiment of the present invention.

The antenna apparatus according to the first embodiment mounts a chip antenna 12 having a meander antenna conductor 22 on the surface or inside of a dielectric chip 20 on a printed circuit board 10 having a ground pattern on one surface of an insulation substrate 16. In the first embodiment, the meander antenna conductor 22 comprises a dense portion 22*a* in meander pitches and a coarse portion 22*b* in meander pitches. The dense portion 22*a* in meander pitches is formed on the side of a power supply terminal 26, and a coarse portion 22*b* in meander pitches is formed at a tip side. In addition, the dense portion 22*a* in meander pitches and the coarse portion 22*b* in meander pitches are formed, respectively, so that meander is repeated a plurality of times. Further, in the first embodiment, the chip antenna 12 is mounted so that part or all of the dense portion 22*a* in meander pitches is overlapped with the ground pattern 18, and a tip side portion (at least coarse portion 22*b* in meander pitches) therefrom is protruded from an end part of the ground pattern 18.

In the above described configuration, the matching between the chip antenna 12 and a coaxial power supply line 14 can be easily achieved by adjusting the size B such that the chip antenna 12 is overlapped with the ground pattern 18, and the VSWR (voltage stationary wave ratio) can be lowered. In the conventional configuration, it is necessary to consider the shape of an antenna conductor or a position of a power supply terminal section in order to lower the VSWR. In addition, there is a problem that the bandwidth is narrowed, if the antenna device is designed to lower the VSWR.

Figure 2B:
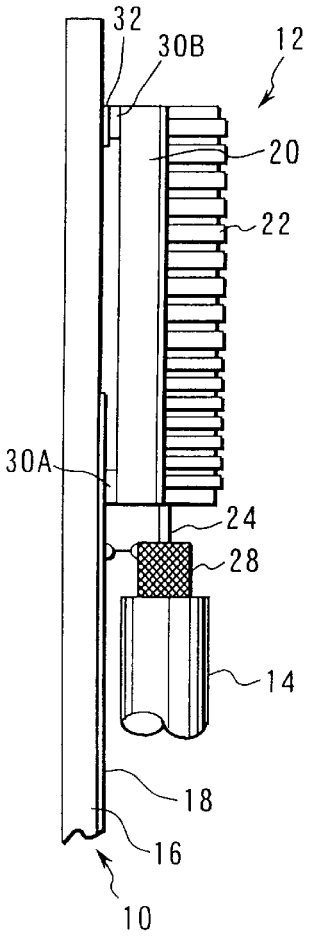
FIG. 2A and FIG. 2B are views each showing an example when the width of a dielectric chip is smaller than the meander width of a meander antenna conductor in an antenna apparatus of a type shown in FIG. 1A and FIG. 1B.
Figure 2A:
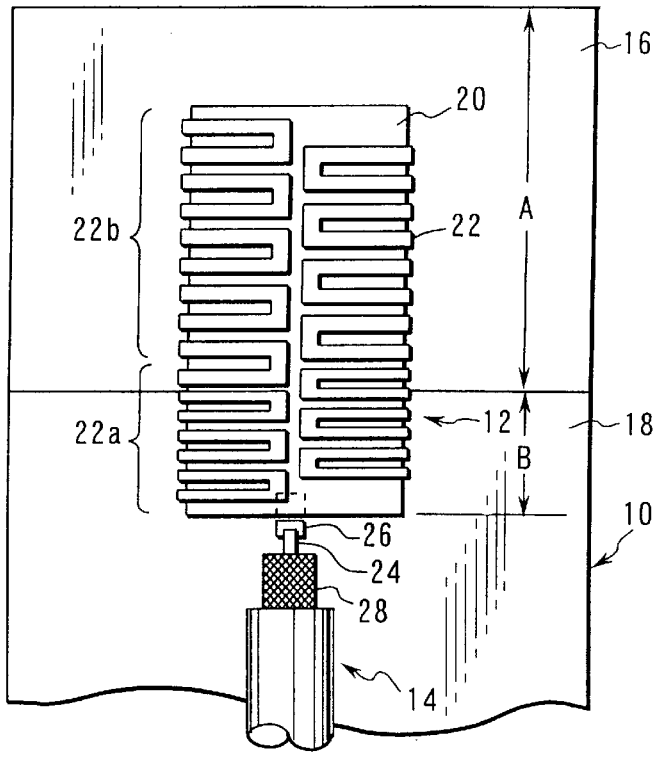

The antenna apparatus shown in FIG. 2A and FIG. 2B is an antenna apparatus to downsize a chip antenna in the antenna device shown in FIG. 1A and FIG. 1B. The chip antenna is configured as follows. The width of the dielectric chip 20 is smaller than the meander width of the antenna conductor 22; an intermediate portion in the meander width direction of the antenna conductor 22 is embedded in the dielectric chip 20; and a both side portion is bent along the surface of the dielectric chip 20.

Figure 3:
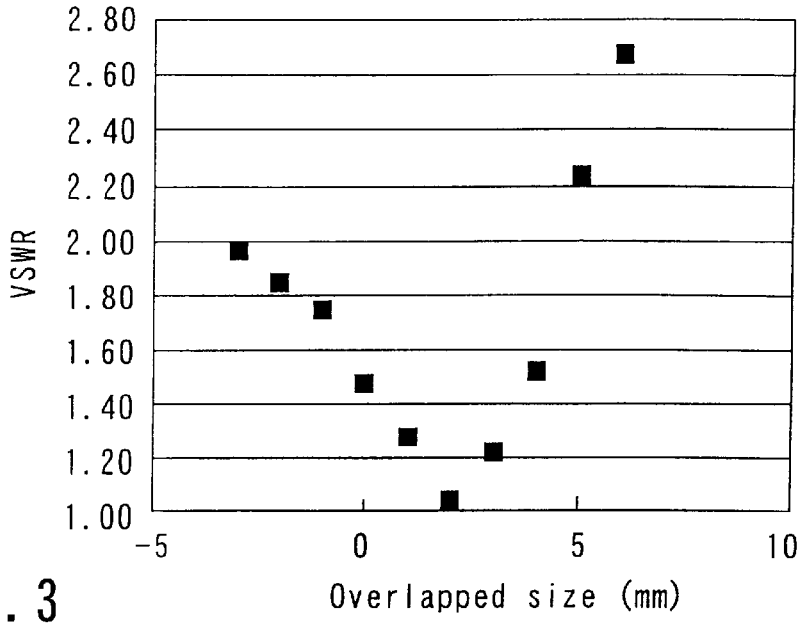
FIG. 3 is a graph showing a change of a VSWR when the overlapped size B of the antenna conductor and the ground pattern is changed in the antenna apparatus shown in FIG. 2A and FIG. 2B.
Figure 4:
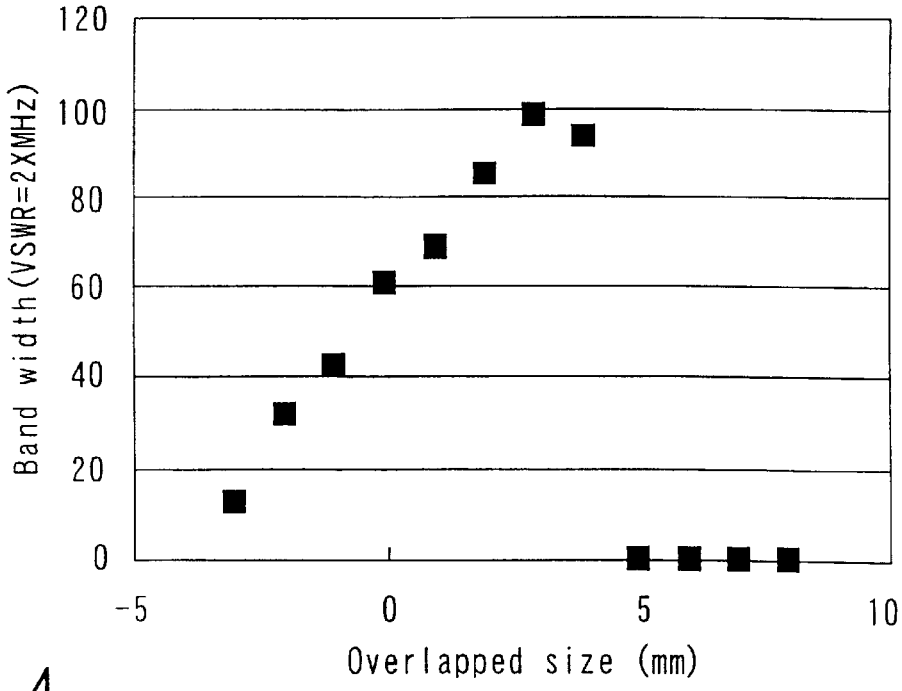
FIG. 4 is a graph showing a change of a bandwidth when the overlapped size B of the antenna conductor and the ground pattern is changed in the antenna apparatus shown in FIG. 2A and FIG. 2B.
Figure 5B:
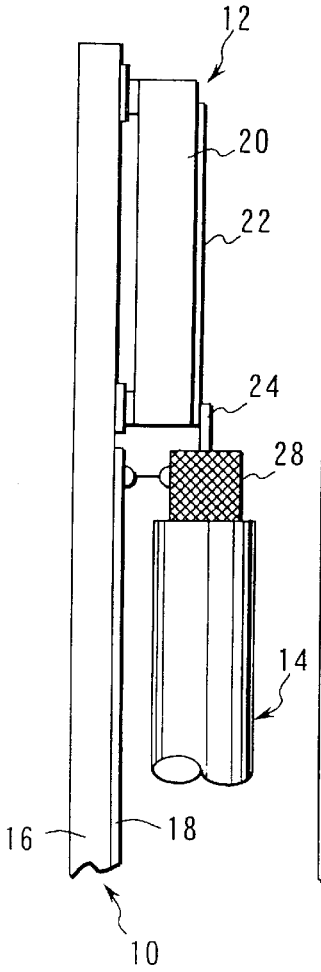
FIG. 5B (PRIOR ART)
Figure 5A:
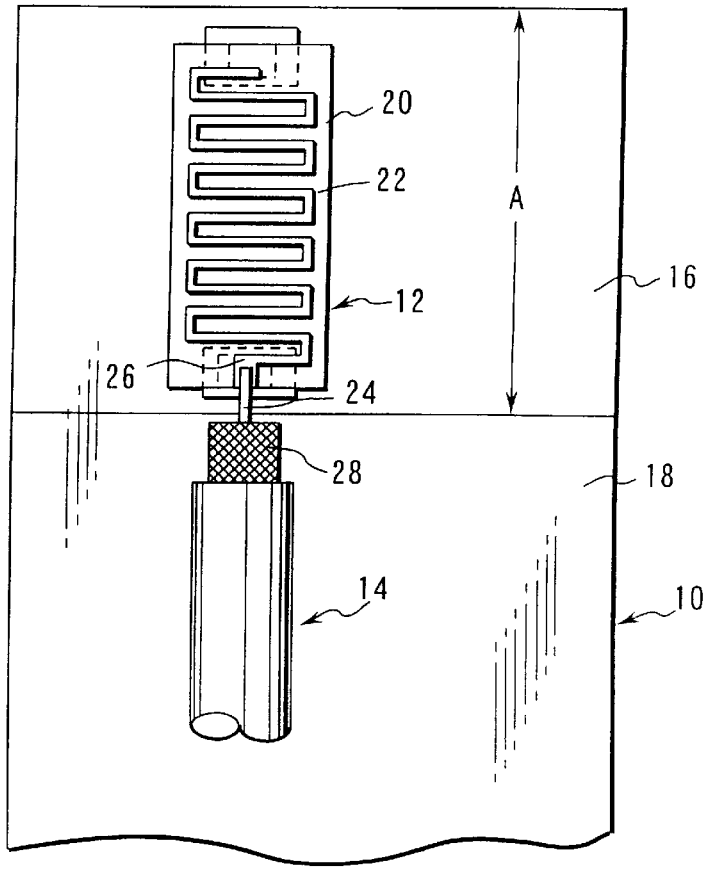
FIG. 5A (PRIOR ART)

FIG. 3 shows a result obtained by measuring a relationship between the overlapped size B and the VSWR in the antenna apparatus as shown in FIG. 2A and FIG. 2B. FIG. 4 shows a result obtained by measuring a relationship between the overlapped size B and the bandwidth in the antenna apparatus as shown in FIG. 2A and FIG. 2B. The size of the print circuit board 10 used is 33 mm in width×150 mm in length (size of the insulation substrate 16); the size of the ground pattern 18 is 33 mm in width×120 mm in length; the size of a fixed pad 32 is 2 mm in width×1 mm in length; the external size of the chip antenna 12 is 4.2 mm in width×16 mm in length×1.1 mm in thickness; the dense portion 22*a* in meander pitches of the meander antenna conductor 22 is 150/150 microns in ratio between a line interval and a line width, and has 27 turns; and the coarse portion 22*b* in meander pitches is 200/200 microns in ratio between a line interval and a line width, and has 17 turns. The meander width of the meander antenna conductor before bent is 8.7 mm. In FIG. 3 and FIG. 4, when the overlapped size B is negative, it indicates the state that the chip antenna is apart from the ground pattern 18 as shown in FIG. 5A and FIG. 5B, and when the size B is positive, it indicates the state that the chip antenna and the ground pattern 18 are overlapped as shown in FIG. 2A and FIG. 2B. Measurement was carried out by connecting the coaxial power supply line 14 to a network analyzer. The resonance frequency is 1033 MHz when B=3 mm.

As seen from FIG. 3 and FIG. 4, when a mount structure according to the first embodiment is employed, the VSWR can be adjusted by adjusting the mount position (size B) of the chip antenna 12. Therefore, the VSWR can be easily adjusted, and an effect that a bandwidth becomes broad where the VSWR is low can be obtained. That is, there is an advantage that matching can be easily obtained. Conventionally, when the VSWR is lowered, the bandwidth is narrowed. However, this disadvantage is remarkably improved according to the first embodiment. In the first embodiment, the side of the dense portion 22*a* in meander pitches is overlapped with the ground pattern 18, and thus, the above-described effect is particularly remarkable. In addition, the printed circuit board 10 can be smaller than conventionally in size A of a region for antenna mounting (a region free of the ground pattern 18), which is effective in downsizing of communication equipment.

Fixed pad sections 30A and 30B formed on the bottom of the dielectric chip 20 are soldered with a ground pattern 18 and a pad 32 formed at a position distant from an edge of the ground pattern 18, whereby the chip antenna 12 is mounted on the printed circuit board 10. The pad 32 is formed so as not to be protruded from the tip of the chip antenna 12, thereby making it possible to further reduce the size A of the region where there is no the ground pattern 18 of the printed circuit board 10.

(Second Embodiment)

Figure 6B:
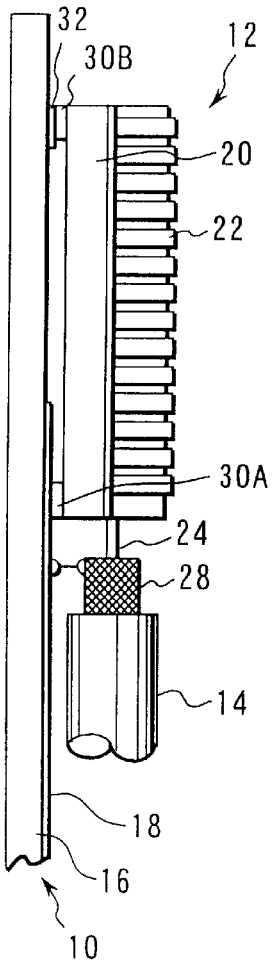
Figure 6A:
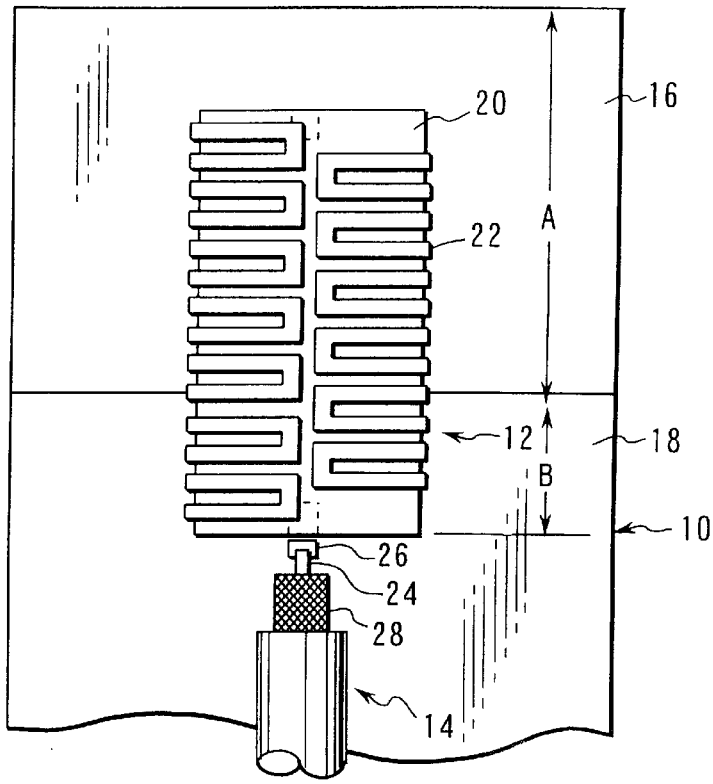

FIG. 6A and FIG. 6B are views each showing an antenna apparatus according to a second embodiment of the present invention. In FIG. 6A and FIG. 6B, the same elements of the antenna apparatus shown in FIG. 2A and FIG. 2B are designated by the same reference numerals and a detailed description will be omitted here.

In the antenna apparatus according to the second embodiment, the meander pitches of the antenna conductor 22 in the antenna apparatus as shown in FIG. 2A and FIG. 2B are constant.

Figure 7:
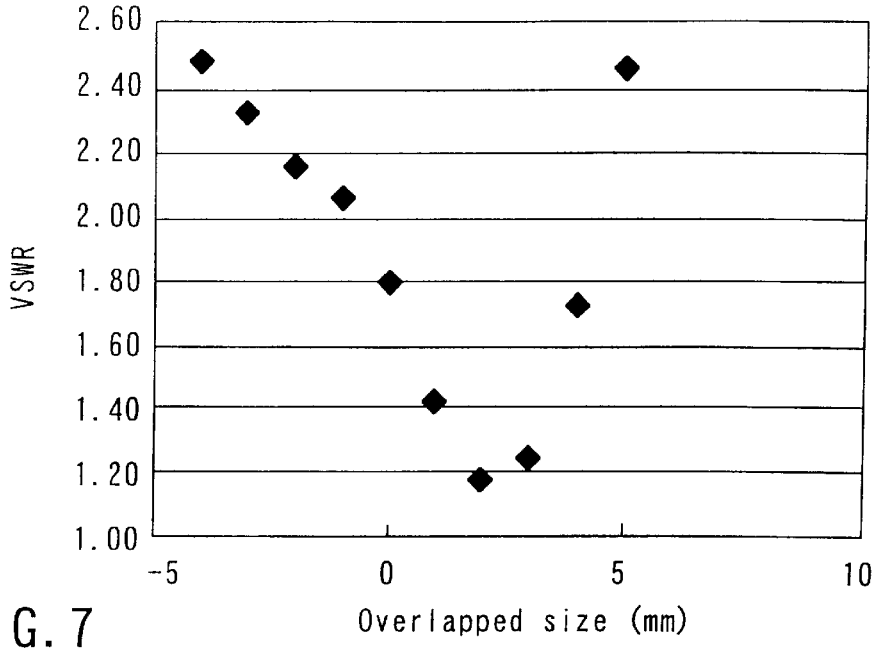
FIG. 7 is a graph showing a change of a VSWR when the overlapped size B of the antenna conductor and the ground pattern is changed in the antenna apparatus shown in FIG. 6A and FIG. 6B.
Figure 8:
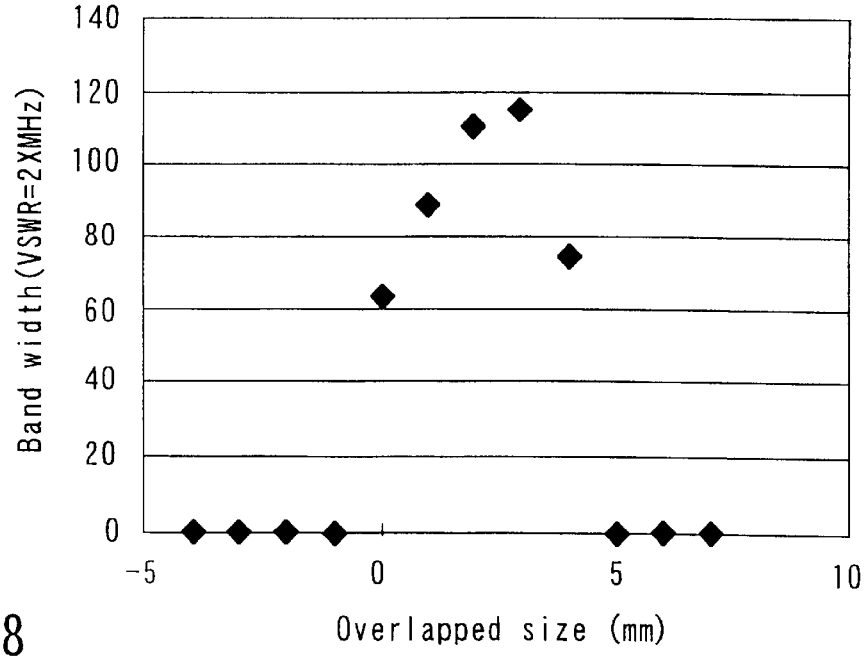
FIG. 8 is a graph showing a change of a bandwidth when the overlapped size B of the antenna conductor and the ground pattern is changed in the antenna apparatus shown in FIG. 6A and FIG. 6B.

FIG. 7 shows a result obtained by measuring a relationship between the overlapped size B and VSWR in the antenna apparatus shown in FIG. 6A and FIG. 6B. In addition, FIG. 8 shows a result obtained by measuring a relationship between the overlapped size B and the bandwidth in the antenna apparatus shown in FIG. 6A and FIG. 6B. In the second embodiment, the size of the printed circuit board 10 used is 33 mm in width×150 mm in length (size of the insulation substrate 16); the size of the ground pattern 18 is 33 mm in width×120 mm in length; the size of the fixed pad 32 is 2 mm in width×1 mm in length; the external size of the chip antenna is 4.3 mm in width×16.0 in length×1.2 mm in thickness; the meander pitch of the meander antenna conductor 22 is 200/180 microns in ratio between a line interval and a line width, and has 37 turns. The meander width of the meander antenna conductor 22 before bent is 8.9 mm. The resonance frequency is 952 MHz when B=3 mm.

According to FIG. 7 and FIG. 8, it is found that the VSWR can be easily adjusted as in the first embodiment, and there is an effect that the bandwidth becomes broad where the VSWR is low.

(Third Embodiment)

FIG. 9A and FIG. 9B are views each showing an antenna apparatus according to a third embodiment of the present invention. In FIG. 9A and FIG. 9B, the same elements of the antenna apparatus shown in FIG. 2A and FIG. 2B are designated by the same reference numerals and a detailed description will be omitted here.

In the antenna apparatus according to the third embodiment, the size of the fixed pad 32 in the antenna apparatus shown in FIG. 6A and FIG. 6B is as large as 4 mm in width×3 mm in length. Further, in the antenna apparatus according to the third embodiment, the fixed pad 32 is protruded more significantly than the tip of the chip antenna 12 by some millimeters (for example, 2 mm).

Figure 10:
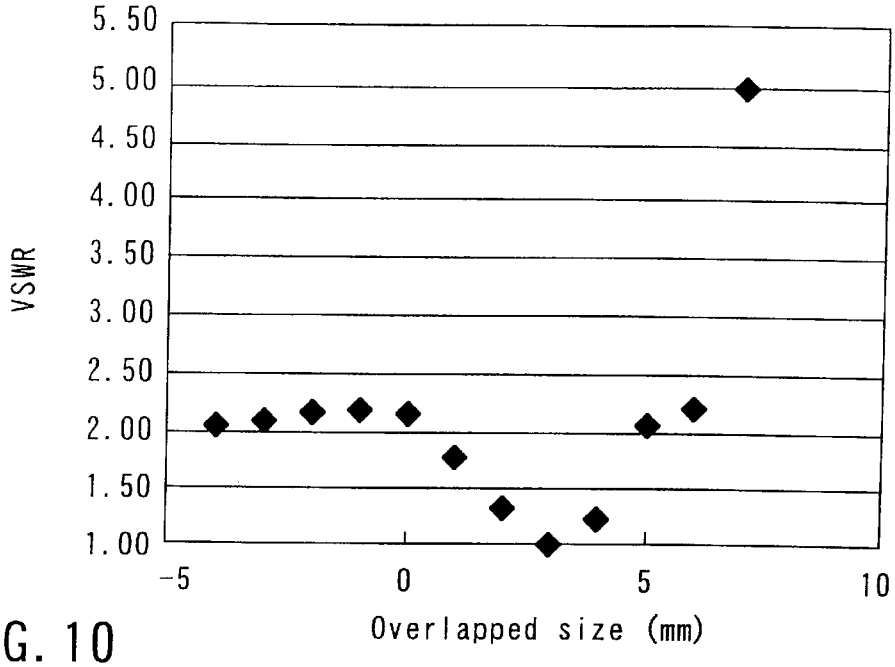
FIG. 10 is a graph showing a change of a VSWR when the overlapped size B of the antenna conductor and the ground pattern is changed in the antenna apparatus shown in FIG. 9A and FIG. 9B.
Figure 11:
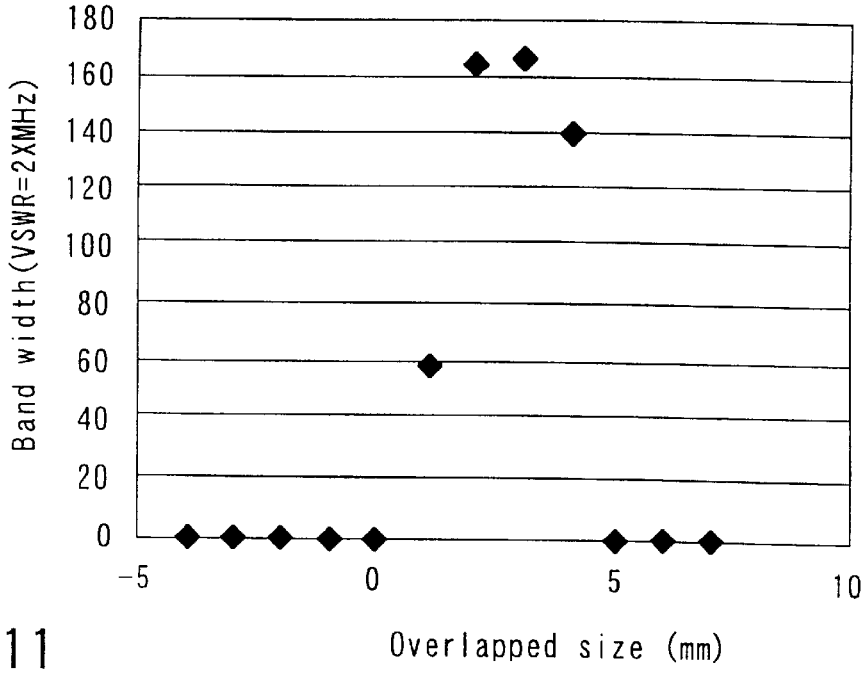
FIG. 11 is a graph showing a change of a bandwidth when the overlapped size B of the antenna conductor and the ground pattern is changed in the antenna apparatus shown in FIG. 9A and FIG. 9B.

FIG. 10 shows a result obtained by measuring a relationship between the overlapped size B and the VSWR in the antenna apparatus shown in FIG. 9A and FIG. 9B. In addition, FIG. 11 shows a result obtained by measuring a relationship between the overlapped size B and the bandwidth in the antenna apparatus shown in FIG. 9A and FIG. 9B. The resonance frequency is 874 MHz when B=3 mm.

According to FIG. 10 and FIG. 11, it is found that the VSWR can be easily adjusted as in the first embodiment, and there is provided an advantageous effects that the bandwidth becomes broad where the VSWR is low.

(Fourth Embodiment)

Figure 12B:
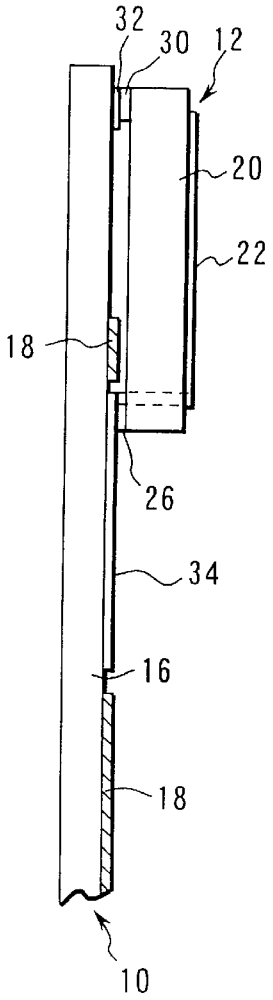
Figure 12A:
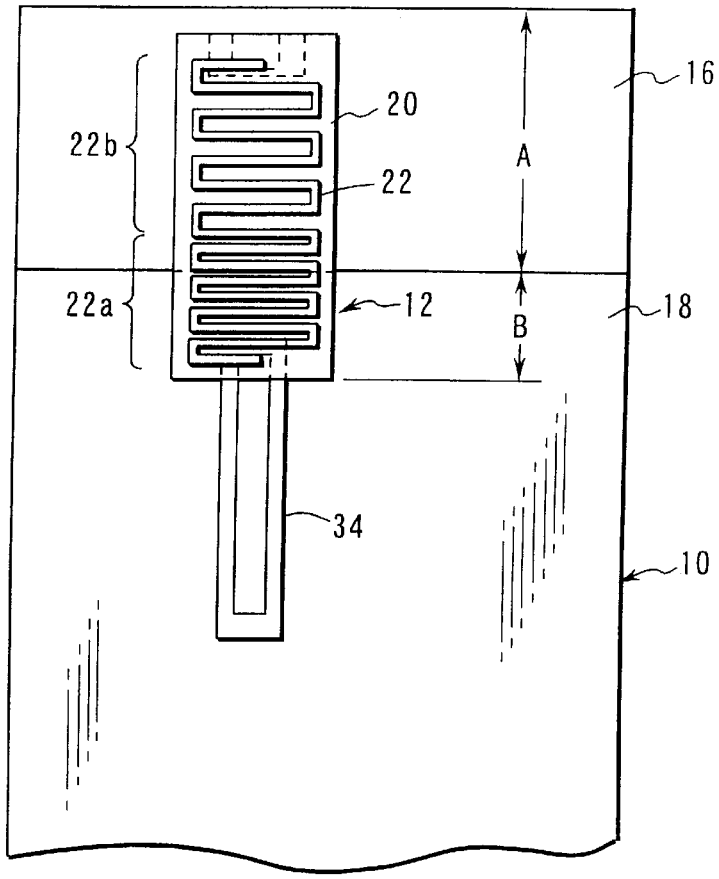

FIG. 12A and FIG. 12B are views each showing an antenna apparatus according to a fourth embodiment of the present invention. In FIG. 12A and FIG. 12B, the same elements in the antenna apparatus shown in FIG. 1A and FIG. 1B are designated by the same reference numerals and a detailed description will be omitted here.

The antenna apparatus according to the fourth embodiment is configured as follows. A strip line 34 is formed as a power supply line on the printed circuit board 10. In addition, a power supply terminal 26 is formed on the lower surface side of the dielectric chip 20 of the chip antenna 12. The power supply terminal 26 of the chip antenna 12 is connected to the strip line 34 by means of soldering or the like. In the antenna apparatus according to the fourth embodiment, the effect similar to that of the first embodiment can be obtained.

(Fifth Embodiment)

Figure 13B:
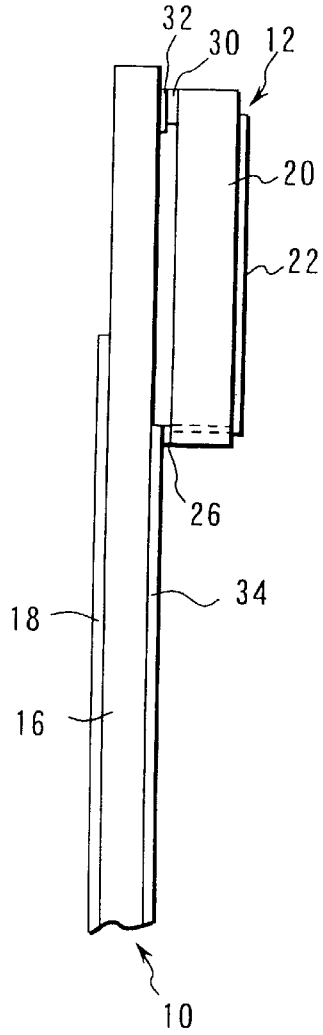
Figure 13A:
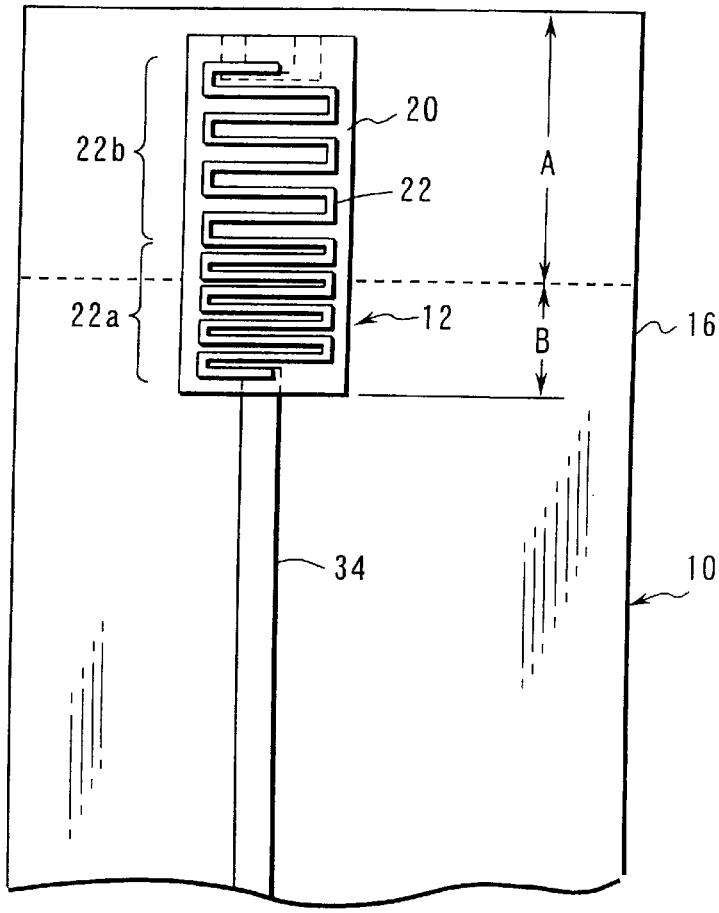

FIG. 13A and FIG. 13B are views each showing an antenna apparatus according to a fifth embodiment of the present invention. In FIG. 13A and FIG. 13B, the same elements of the antenna apparatus shown in FIG. 1A and FIG. 1B are designated by the same reference numerals and a detailed description will be omitted here.

In the antenna apparatus according to the fifth embodiment, a power supply strip line 34 of an insulation substrate 16 is formed on a surface on which a chip antenna 12 is mounted, and a ground pattern 18 is provided on the opposite surface.

In the first embodiment to the fifth embodiment, a case in which meander pitches of the meander antenna conductor of the chip antenna is uniformed and a case in which the pitches are densely provided on the side of the power supply terminal, and are coarsely provided at the tip side are described. It is not limited to the above-mentioned embodiments, the chip antenna may be coarsely provided on the side of the power supply terminal or may be densely provided at the tip side in meander pitches of the meander antenna conductor.

In addition, in the first embodiment to the fifth embodiment, a case in which the antenna conductor of the chip antenna is formed in the meander shape is described. However, the present invention is also applicable similarly to a case in which the antenna conductor of the chip antenna is formed in the helical shape.

According to the first embodiment to the fifth embodiment, the chip antenna is mounted on the substrate so that the antenna conductor at the side of the power supply terminal is overlapped with a ground pattern. In this manner, the size of a region where there is no substrate ground pattern can be reduced. Therefore, the size of the communication equipment can be reduced. In addition, when the power supply terminal side of the chip antenna is overlapped with the ground pattern, the matching between the chip antenna and the power supply line can be achieved by adjusting the overlapped size, thus making it possible to facilitate antenna design or manufacture.

(Sixth Embodiment)

Figure 14A:
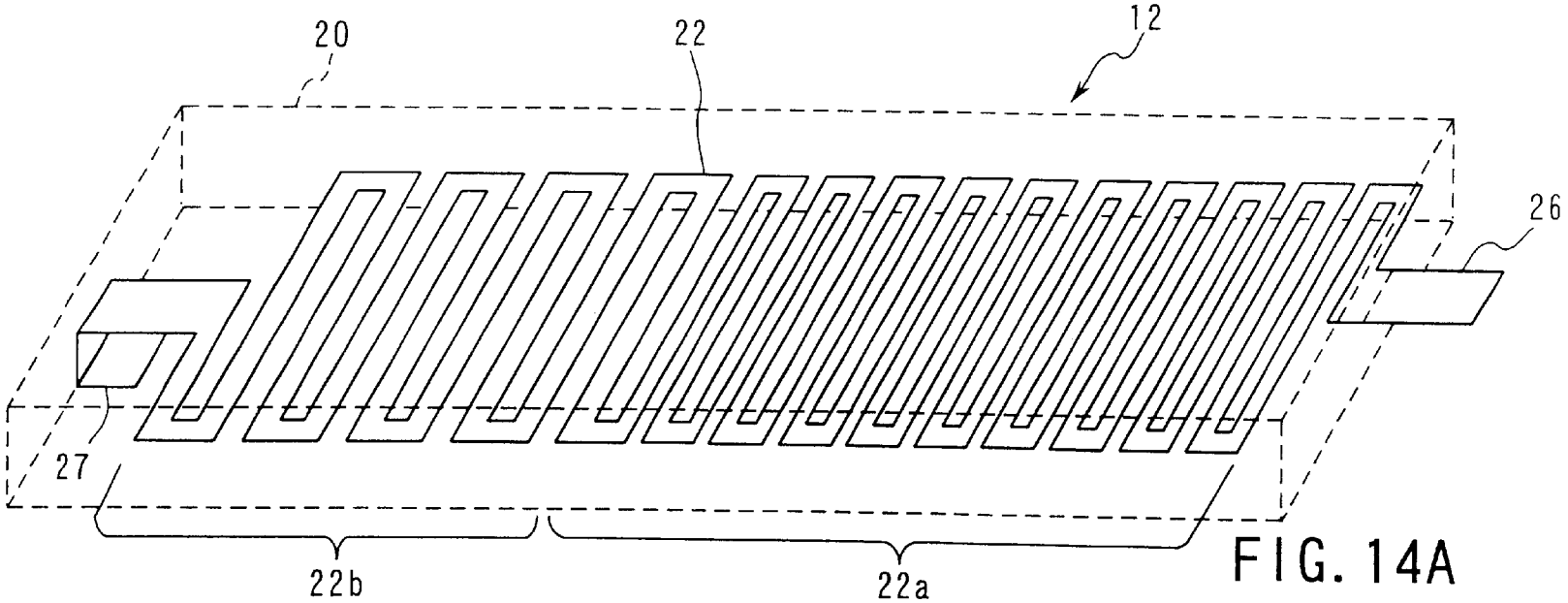
Figure 14B:
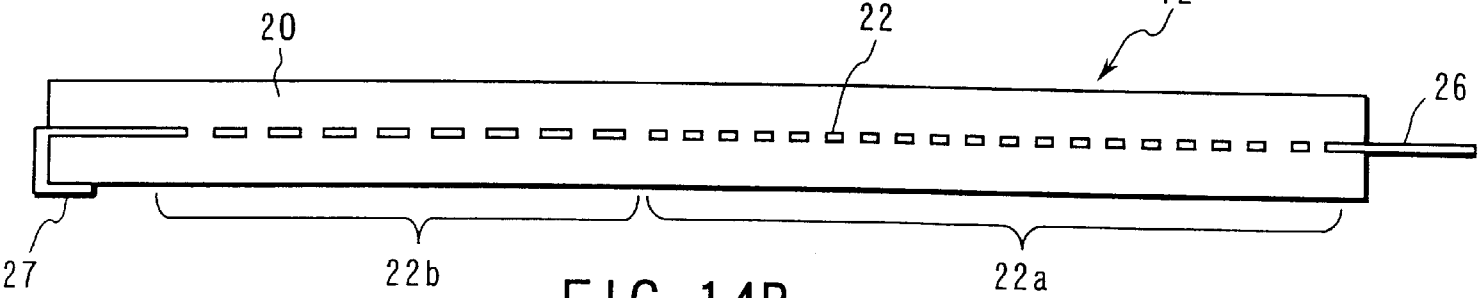

FIG. 14A and FIG. 14B are views each showing an antenna apparatus according to a sixth embodiment of the present invention. In FIG. 14A and FIG. 14B, the same elements of the antenna apparatus shown in FIG. 1A and FIG. 1B are designated by the same reference numerals.

A chip antenna 12 according to the sixth embodiment is substantially similar to that according to the first embodiment in shape of the meander antenna conductor 22. However, a meander antenna conductor 22 formed in a planer shape is embedded in the dielectric chip 20. In the meander antenna conductor 22, meander is advanced in a unidirectional manner. This antenna conductor 22 has a dense portion 22*a* and a coarse portion 22*a* in meander pitches. The dense portion 22*a* in meander pitches is provided on the side of the power supply terminal 26 of the antenna conductor 22. On the other hand, the coarse portion 22*b* in meander pitches is provided at the tip side. The dense portion 22*a* and coarse portion 22*b* in meander pitches are formed, respectively, so that meander is repeated in the plurality of pitches. In addition, the dense portion 22 in meander pitches is formed to have more turns (here, the number of turns corresponds to twice of pitches in number) than the coarse portion 22*b* in meander pitches. The power supply terminal 26 is protruded outside of the dielectric chip 20, and the tip part of the antenna conductor 22 is bent along an outer surface of the dielectric chip 20, thus configuring a fixed terminal 27. The power supply terminal 26 may also be formed in a manner similar to the fixed terminal 27. The bandwidth can be more widened by broadening the conductor line width of the coarse portion 22*b* in meander pitches than the conductor line width of the dense portion 22*a*.

In examples shown in FIG. 14A and FIG. 14B, the power supply terminal 26 is provided at the side of the dense portion 22*a* in meander pitches, and the fixed terminal 27 is provided at the side of the coarse portion 22*b*. In contrast, the power supply can be provided at the side of the coarse portion 22*b* in meander pitches, and the fixed terminal may be provided on the side of the dense portion 22*a*. However, as described later, the resonance frequency can be lowered more remarkably in the configuration shown in FIG. 14A and FIG. 14B.

Figure 15B:
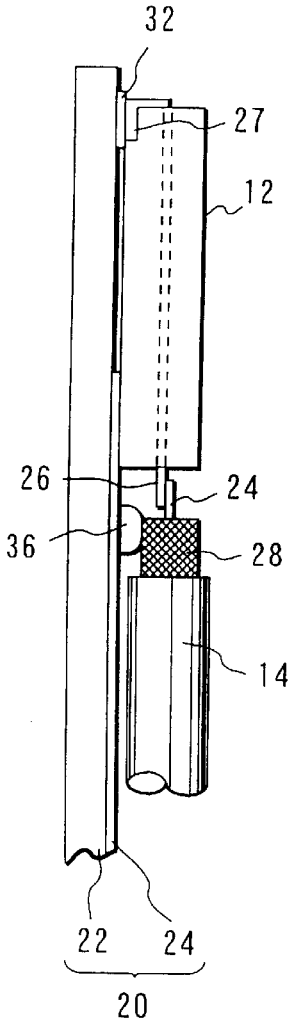
Figure 15A:
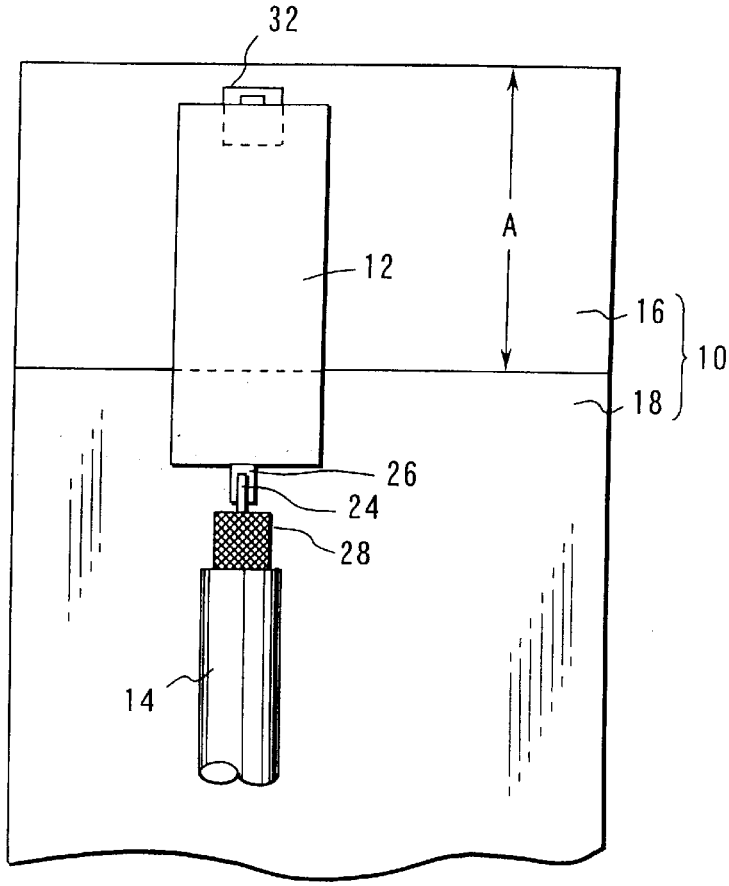

FIG. 15A and FIG. 15B show a state in which the above described chip antenna 12 is mounted on the circuit board 10, and antenna performance test is carried out. The circuit board 10 has a ground pattern 18 while the size A of a partial region is left on one surface of the insulation substrate 16. The chip antenna 12 is mounted so that a part of the power supply terminal 26 is overlapped with the ground pattern 18, and a center conductor 24 of a coaxial power supply line 14 is connected to the power supply terminal 26. An external conductor 28 of the coaxial power supply line 14 is fixed by a soldering section 36. The fixed terminal 27 at the tip part of the chip antenna 12 is soldered to the pad 32 formed in a region free of the ground pattern 18 of the insulation substrate 16.

Two types of antennas, i.e., one antenna in which a power supply terminal is provided at the dense portion in meander pitches as shown in FIG. 14A and FIG. 14B (Example 1), and on the contrary, the other antenna in which a power supply terminal is provided at the coarse portion in meander pitches (Example 2) are provided as the chip antennas according to the embodiment of the present invention provided for test. The size of each chip antenna and the circuit substrates having the antenna is as follows.

Meander width of the meander antenna conductor 22: 7.2 mm

Thickness of the meander antenna conductor 22: 100 microns

Dense portion 22*a* in meander pitches: Ratio between line width and line interval=150/150 microns 25 turns Coarse portion 22*b* in meander pitches: Ratio between line width and line interval=200/200 microns 17 turns Length, width, and thickness of the dielectric chip 20: 15×8×0.6 mm Dielectric rate of the dielectric chip 20: 3.4

Length and width of the ground pattern 18: 120×33 mm

Length of the overlapped portion between the ground pattern 18 and the chip antenna 12: 2 mm For comparison, a chip antenna (Comparative Example 1) which is the same as the above is fabricated except that meander pitches are constant (ratio between line width and line interval=170.6/170.6 microns, 42 turns), and the same test is carried out by mounting a circuit substrate which is the same as the above in the same manner. The result is shown in Table 1.

TABLE 1

| | Bandwidth (MHz) (VSWR = 2) | Center frequency (MHz) | Specific bandwidth (%) |
|---|---|---|---|
| Example 1 Power supply on dense side | 96 | 849 | 11.3 |
| Example 2 Power supply on coarse side | 141 | 930 | 15.2 |
| Comparative Example 1 No dense or coarse portion | 81 | 854 | 9.4 |

According to Table 1, it is found that the antennas each having a coarse portion and a dense portion provided thereat (Example 1 and Example 2) can be increased in bandwidth more significantly than antenna with its constant meander pitches (Comparative Example 1). In addition, it is found that the center frequency when power is supplied from the side at which meander pitched are dense can be lowered more remarkably than that when power is supplied from the side at which the pitches are coarse. Although the center frequency can be lowered in antenna densely downsized while meander pitches are constant (Comparative Example 1), there is a difficulty that the bandwidth and specific bandwidth decrease.

(Seventh Embodiment)

Figure 16A:
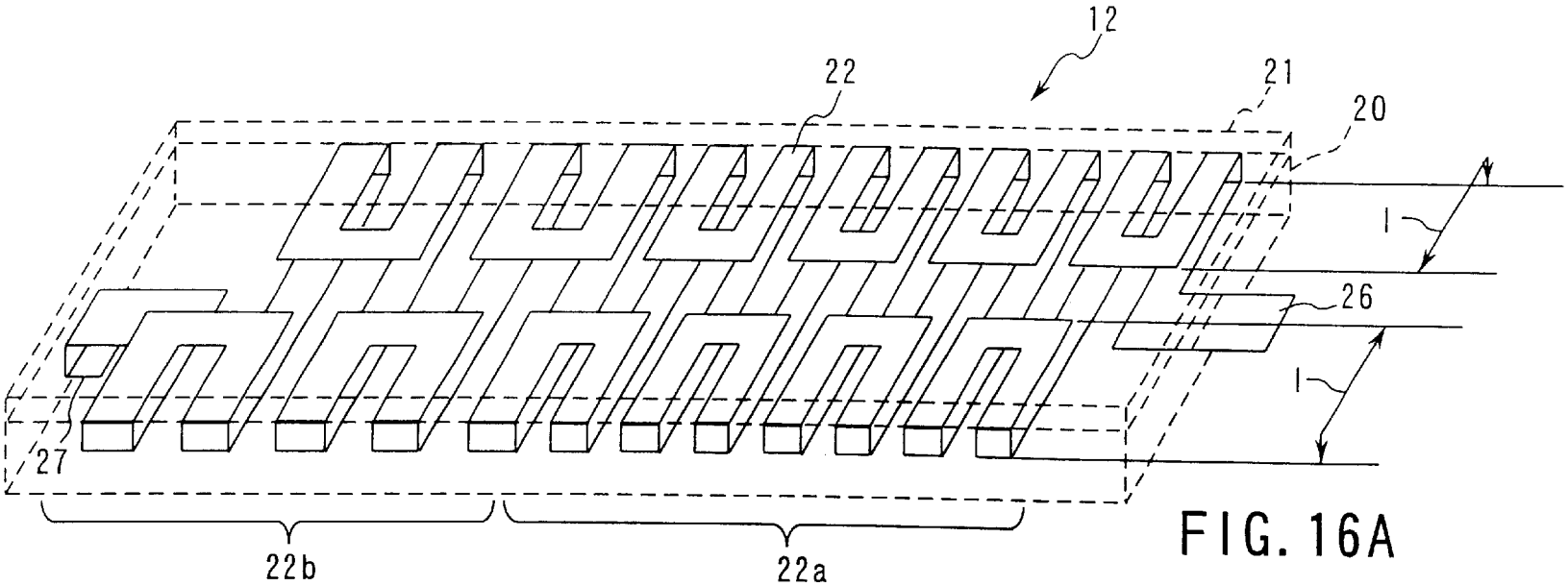
Figure 16B:
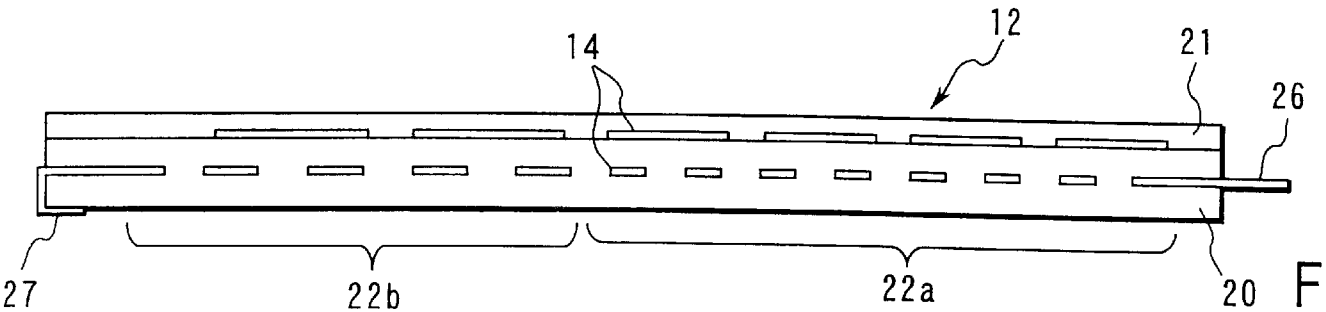

FIG. 16A and FIG. 16B are views each showing a chip antenna of an antenna apparatus according to a seventh embodiment of the present invention. In FIG. 16A and FIG. 16B, the same elements of the antenna apparatus shown in FIG. 14A and FIG. 14B are designated by the same reference numerals.

The chip antenna 12 according to the seventh embodiment is configured as follows. An intermediate portion in the meander width direction of the meander antenna conductor 22 is embedded in a dielectric chip 20. Then, both end parts in the meander width direction are returned so as to be overlapped with the intermediate portion along the outer periphery surface of the dielectric chip 20, and the meander antenna conductor 22 is formed in a three-dimensional manner. With this configuration, the width of the chip antenna 12 can be reduced. A resin coating 21 is provided on a surface on which the both end parts in the meander width direction of the meander antenna conductor 22 is bent.

The seventh embodiment is the same as the sixth embodiment in that the meander antenna conductor 22 has a dense portion 22*a* and a coarse portion 22*b* in meander pitches, and the dense portion 22*a* has more meander pitches than the coarse portion 22*b*; and a method of arranging a power supply terminal 26 and a fixed terminal 27, etc.

Next, the performance of the chip antenna configured as shown in FIG. 16A and FIG. 16B is checked. The chip antenna according to the present invention, which is provided for test, has two types of which a power supply terminal is provided at the side of the dense portion in meander pitches (Example 3), and on the contrary, a power supply terminal is provided at the side at the coarse portion in meander pitches (Example 4). The sizes or the like of both of these antennas are as follows. Both end parts in the meander width direction of the meander antenna conductor, i.e., a portion of width 1=(1.4) mm, were turned back, and the external size of the antenna was set to 16×4.4×1.2 mm. These Examples 3 and 4 are the same as Examples 1 and 2 except that a dielectric rate of the dielectric chip was set to 20. The sizes or the like of the circuit substrate are the same as well.

For comparison, by using a meander antenna conductor which is the same as that according to Comparative Example 1, the chip antenna (Comparative Example 2) returned at both end parts in the meander width direction is fabricated in the same manner as that according Example 3 and Example 4, and the same tests are carried out for this antenna. The result is shown in Table 2.

TABLE 2

| | Bandwidth (MHz) (VSWR = 2) | Center frequency (MHz) | Specific bandwidth (%) |
|---|---|---|---|
| Example 3 Power supply on dense side | 94 | 997 | 9.5 |
| Example 4 Power supply on coarse side | 84 | 1036 | 8.1 |
| Comparative Example 2 No dense or coarse portion | 81 | 1043 | 7.8 |

The above result shows a tendency which is similar to that shown in Table 1. In addition, from the result shown in Table 2, it is found that the dense side power supply has a broader ratio bandwidth than the coarse side power supply in an antenna turned back at the width end part as shown in FIG. 16A and FIG. 16B. Moreover, the center frequency is lower in dense side power supply. From this result, it is found that, when dense side power supply is carried out at dense and coarse meanders in return, "downsizing" and "wider bandwidth" can be achieved at the same time.

In the sixth embodiment and seventh embodiment, a chip antenna having a meander antenna conductor is described. However, the present invention is also applicable to a chip antenna having a helical shaped antenna conductor.

(Eighth Embodiment)

Figure 17B:
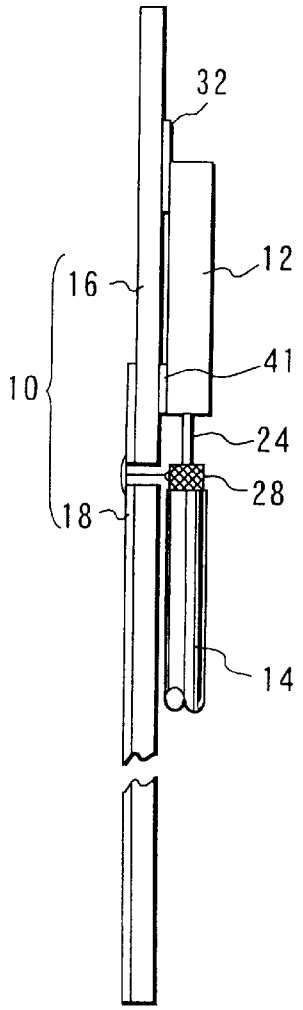
FIG. 17A and FIG. 17B are front views each showing an antenna apparatus according to an eighth embodiment of the present invention.
Figure 17A:
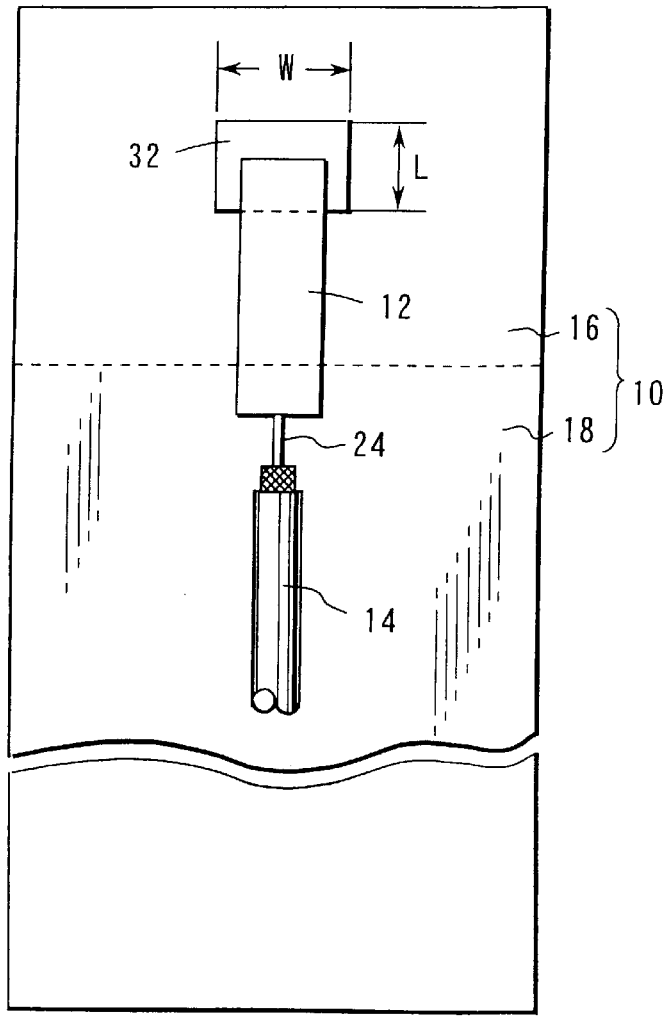

FIG. 17A and FIG. 17B are views each showing an antenna apparatus according to an eighth embodiment of the present invention. In FIG. 17A and FIG. 17B, the same elements of the antenna apparatus shown in FIG. 1A and FIG. 1B are designated by the same reference numerals.

The antenna apparatus according to the eighth embodiment mounts a chip antenna on a printed circuit board 10 having a ground pattern 18 on one surface of an insulation substrate 16. The printed circuit board 10 has a rectangular pad 32 for mounting the antenna at a position distant from an edge of the ground pattern 18 of a surface at the opposite side of the ground pattern 18 on the insulation substrate 16. The tip part of the chip antenna 12 is positioned on the pad 32, and the base end part (at the side of the power supply terminal) thereof the chip antenna is mounted so that the base end part is overlapped with the ground pattern 18. A coaxial power supply line 14 is connected to the chip antenna 12. A strip line formed on the printed circuit board 10 may be used instead of the coaxial power supply line 14. As shown in FIG. 21, the chip antenna 12 has a meander antenna conductor 22 provided inside of the dielectric chip 20. The meander antenna conductor 22 is bent so that both end parts of the meander width direction is overlapped with the intermediate portion (namely, so that both ends in the meander width direction are close to each other). In addition, the meander antenna conductor 22 is formed so that the meander pitches are dense at the side of the power supply terminal 26, and the meander pitches are coarse at the tip side. The dense portion 22*a* and coarse portion 22*b* in meander pitches of the meander antenna conductor 22 are formed, respectively, so that meandering is repeated in a plurality of pitches. The power supply terminal 26 is a portion to which the center conductor 24 of the coaxial power supply line 14 is connected. In addition, a first fixed terminal 27 is formed at a position corresponding to the back side of the power supply terminal 26, and a second fixed terminal 40 is formed at a position corresponding to the back side at a tip of the meander antenna conductor 22. The second fixed terminal 40 is electrically conductive to the meander antenna conductor 22 via a conductor 22*c* going round an end surface of a dielectric chip 20. In addition, a resin cover 21 is provided on a surface on which both end parts in the meander width direction of the meander antenna conductor 22 of the dielectric chip 20 are mounted. In the chip antenna formed as mentioned above, the first fixed terminal 27 is positioned on the pad 41, and the second fixed terminal 40 is positioned on the pad 32, whereby the antenna is mounted so that part or all of the dense portion 22*a* in meander pitches is overlapped with the ground pattern 18. This mounting is carried out in the same manner as that in general surface mount type parts. When the antenna is mounted so that the dense portion 22*a* in meander pitches of the meander antenna conductor 22 is overlapped with the ground pattern 18, the matching between the chip antenna 12 and coaxial power supply line 14 can be easily achieved by adjusting the overlapped size.

Figure 18:
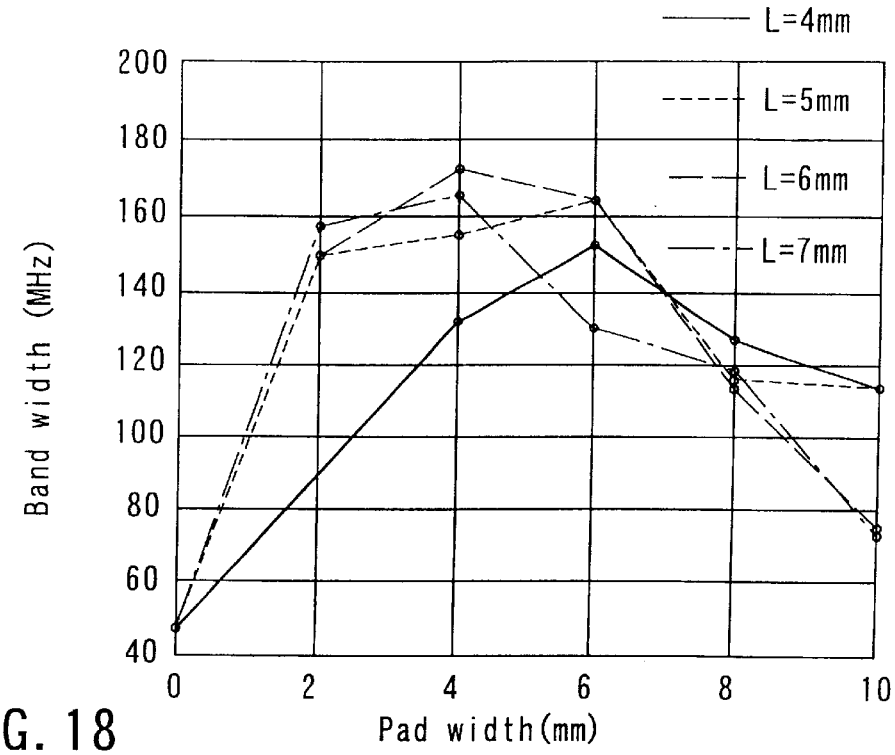
FIG. 18 is a graph showing a relationship between a pad width and a bandwidth of the antenna apparatus shown in FIG. 17A and FIG. 17B.
Figure 19:
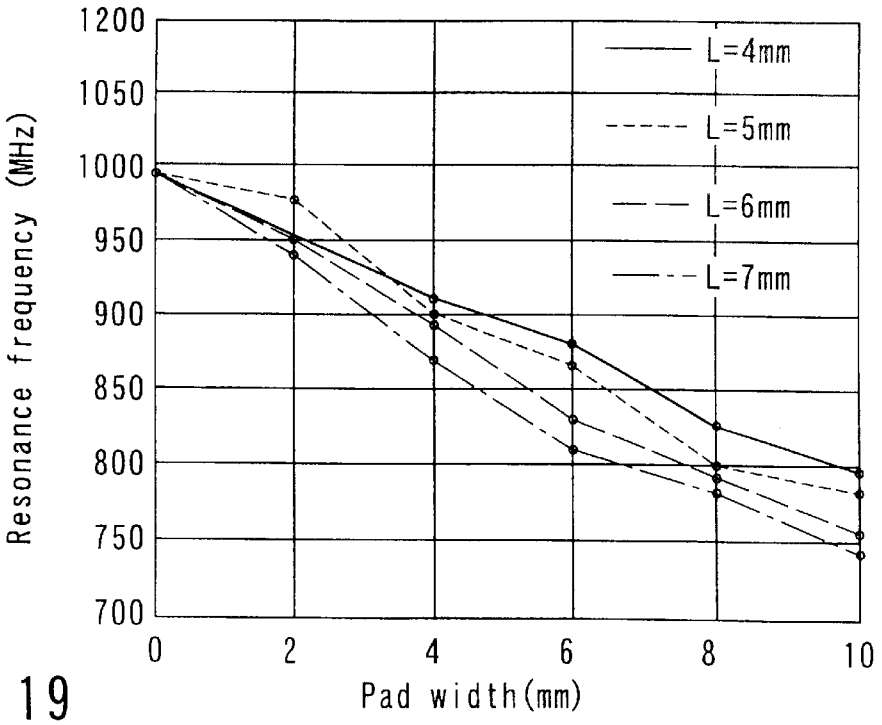
FIG. 19 is a graph showing a relationship between a pad width and a resonance frequency of the antenna apparatus shown in FIG. 17A and FIG. 17B.
Figure 20:
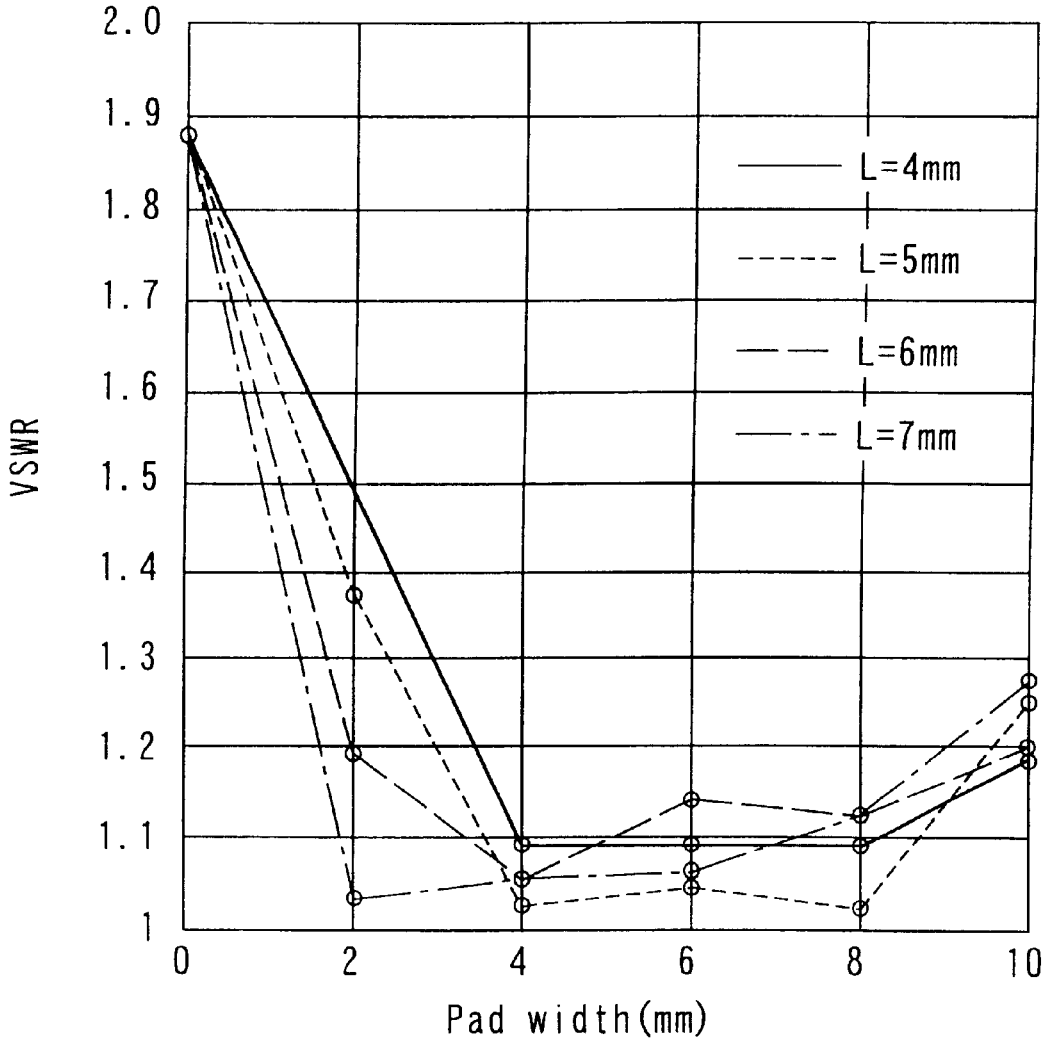
FIG. 20 is a graph showing a relationship between a pad width and a VSWR of the antenna apparatus shown in FIG. 17A and FIG. 17B.
Figure 21A:
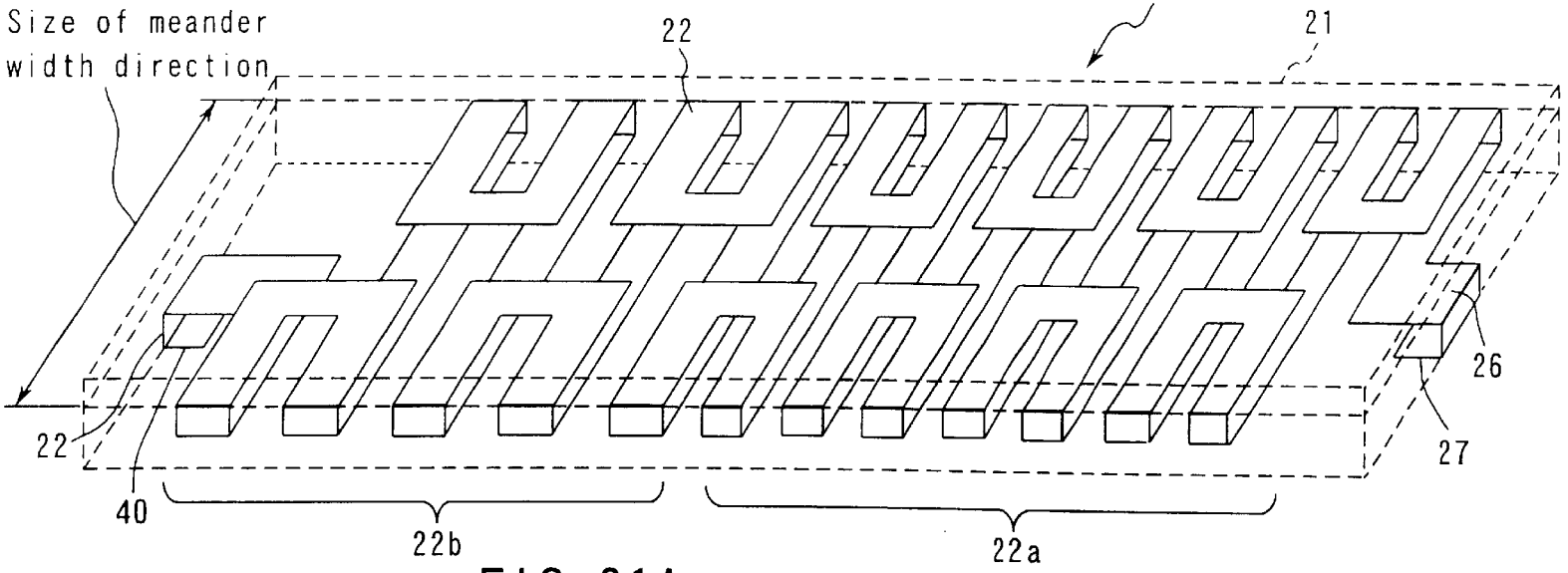
Figure 21B:
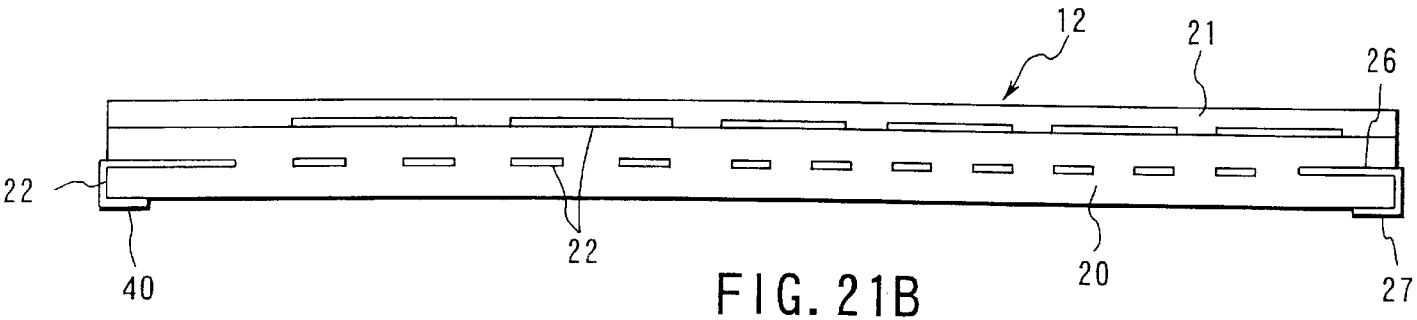

The antenna of FIG. 17 is manufactured for test and the performance thereof is checked. It is found that a bandwidth greatly changes due to the size of the pad 32 formed on the printed circuit board 10. Thus, various tests are carried out by changing a width W and a length L of the pad 32. The result is shown in FIG. 18 to FIG. 20. The chip antenna 12 used is bent on the intermediate portion at both end parts in the meander width direction of the meander antenna conductor 22, as shown in FIG. 21A and FIG. 21B. The meander pitches are dense at the side of the power supply terminal 26, and are coarse at the further tip side. The meander width of the meander conductor 22 (the width direction when extended) is 8.7 mm; the length in the meander direction is 15 mm; the dense portion 22*a* in meander pitches is 150/150 microns in ratio between a conductor width and a conductor interval and has 27 turns, and the coarse portion 22*b* in meander pitches is 200/200 microns in ratio between a conductor width and a conductor internal and has 17 turns; and the size in the meander width direction after bending both end portions is 4 mm. The thickness of the dielectric chip 20 is 1 mm, and the dielectric rate is 20. The chip antenna 12 is mounted so as to be overlapped with the ground pattern by 3 mm at the side of the power supply terminal 26 of the meander antenna conductor 22 and so as to be overlapped with the pad 32 by 3 mm at the tip side.

FIG. 18 shows a result obtained by measuring a change in bandwidth when the pad width W and length L are changed. According to the figure, it is found that, as long as the pad width W is 8 mm or less, which is twice of the size (4 mm) in the meander width direction of the meander antenna conductor 22, a wide bandwidth is obtained. In addition, if the pad width is larger than two times of the size in the meander width direction of the meander antenna conductor 22, it is found that the bandwidth is greatly lowered. Therefore, it is required to set the pad width W to be twice or less of the size in the meander width direction of the meander antenna conductor.

In order to ensure wider bandwidth, it is preferable that the pad width W is to be 1.75 times or less of the size in the meander width direction of the meander antenna conductor. It is further preferable that the width is to be 1.5 times or less. In addition, even if the pad width is reduced, the bandwidth is not narrowed. However, in consideration of the stability when the chip antenna is mounted, it is preferable that the pad width W is to be 0.5 times or more of the size in the meander width direction of the meander antenna conductor. It is further preferable that the width is to be 1 times or more. FIG. 19 shows a result obtained by measuring a resonance frequency when the pad width W and length L are changed. Accordingly, it is found that an increase in pad width W can lower the resonance frequency. This is because an increase in pad width introduces the same effect as lengthening an antenna conductor length.

FIG. 20 shows a result obtained by measuring the VSWR when the pad width W and length L are changed. From this result as well, it is found that the pad width is to be 8 mm, which is twice or less of the meander width size of the meander antenna conductor.

Figure 22A:
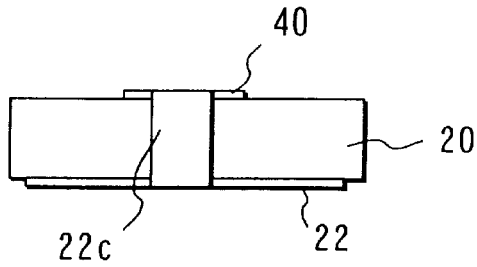
Figure 22B:
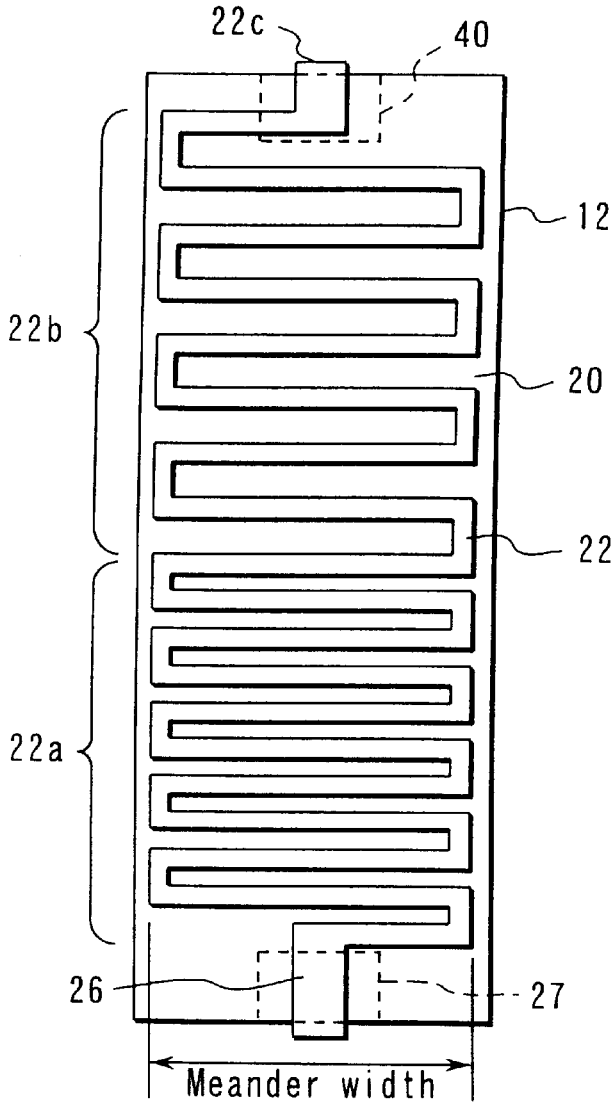
Figure 22C:
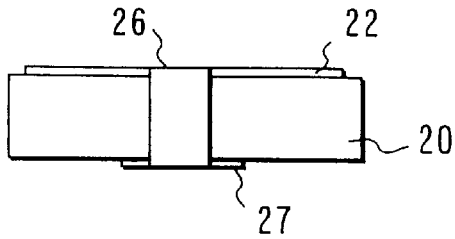

In the eighth embodiment, a chip antenna may be formed in the shape as shown in FIG. 22A to FIG. 22C as in the first embodiment. In this chip antenna 12, the meander antenna conductor 22 is provided on the surface (or inside) of a dielectric chip 20 with its high dielectric rate. The meander antenna conductor 22 is formed so as to dense in meander pitches at the side of the power supply terminal 26 and so as to be coarse in meander pitches at the tip side. The dense portion 22*a* and coarse portion 22*b* in meander pitches of the meander antenna conductor 22 are formed, respectively so that meander is repeated in a plurality of pitches. The power supply terminal 26 is a portion to which the center conductor 24 of the coaxial power supply line 14 is connected. In addition, on the back surface of the dielectric chip 20, a first fixed terminal 27 is formed at a position corresponding to the back side of the power supply terminal 26, and a second fixed terminal 40 is formed at a position corresponding to the back side at the tip of the meander antenna conductor 22. The second fixed terminal 40 is electrically conductive to the meander antenna conductor 22 via the conductor 22*c* going round an end surface of the dielectric chip 20. The first fixed terminal 27 is positioned on the pad 41, and the second fixed terminal 40 is positioned on the pad 32, whereby the antenna is mounted so that part or all of the dense portion 22*a* in meander pitches is overlapped with the ground pattern 18. This mounting is carried in the same way as that for a surface mount type parts. When the antenna is mounted so that the dense portion 24*a* in meander pitches of the meander antenna conductor 22 is overlapped with the ground pattern 18, the matching between the chip antenna 12 and the coaxial power supply line 14 can be easily achieved by adjusting the overlapped size.

When the antenna apparatus as described above is fabricated, and the performance is tested, a tendency similar to that according to the eighth embodiment is obtained.

Although in the eighth embodiment, it is described that the pad is formed in a rectangular shape, the pad may be formed in another shape without being limited to such rectangular shape.

According to each of the above described embodiments, a small sized chip antenna with its wide bandwidth can be obtained.

The width of the pad fixing the tip side of the chip antenna is set to be twice or less of the meander width of the meander antenna conductor, whereby the wide bandwidth of the antenna can be achieved. Further, since the tip side of the chip antenna is loaded on the pad for increasing the bandwidth, it is possible to further downsize the chip antenna and also reduce the size of a tip more than an edge of the substrate ground pattern (a region free of the ground pattern), thereby downsizing the substrate.

The following inventions can be introduced from each of the above-mentioned embodiments.

The antenna apparatus according to the present invention is characterized by comprising: a substrate; a chip antenna mounted on the substrate; and a ground pattern disposed on the substrate, at least a portion on the side of a power supply terminal of an antenna conductor in the chip antenna being overlapped with said ground pattern. According to this antenna apparatus, the substrate size can be reduced by the overlapped size of the chip antenna and the ground pattern. Further, the matching between the chip antenna and the power supply line can be easily achieved.

As a chip antenna, there can be used: (1) a meander antenna conductor provided on the surface or inside of the dielectric chip; or (2) a helical shaped conductor provided thereon or inside thereof. The meander of the antenna conductor and/or helical pitches may be uniform, and a coarse portion and a dense portion may be present.

It is preferable that the chip antenna has a meander antenna conductor; the meander antenna conductor 22 comprises a dense portion in meander pitches and a coarse portion in meander pitches; and part or all of the dense portion in meander pitches is mounted on the substrate to overlap the ground pattern. When the antenna conductor of the chip antenna is formed in a helical shape, it is preferable that the chip antenna is mounted on the substrate so that helical pitches of the antenna conductor are dense at the side of the power supply terminal and are coarse at the tip side, and part or all of the dense portion in helical pitches of this helical shaped antenna conductor is overlapped with the ground pattern.

With such a configuration, adjustment for obtaining matching can be made more easily.

It is preferable that each of the above described antenna apparatuses comprises the pad mounted on the substrate and fixing the tip portion of the chip antenna at a distant position from the edge of the ground pattern and the pad is formed not to protruded from the tip of the chip antenna to further downsize the substrate.

Another antenna apparatus according to the present invention is characterized by comprising a chip antenna, in which an antenna conductor has a meander shape or helical shape, and said antenna conductor has a dense portion and a coarse portion in meander pitches or helical pitches. This makes it possible to ensure that antenna downsizing and widening of the bandwidth are compatible with each other.

In the above described antenna apparatus, to further widen a bandwidth, it is preferable that a dense portion in meander pitches or helical pitches are provided on a power supply terminal side of the antenna conductor, and a coarse portion is provided at a tip side of the antenna conductor.

In addition, in the above each antenna apparatus, to further downsize the antenna apparatus, it is preferable that a number of turns at a dense portion in meander pitches or helical pitches is larger than a number of turns at a coarse portion.

Another antenna apparatus according to the present invention is an antenna apparatus in which a chip antenna having a meander antenna conductor provided on the surface or inside of the dielectric chip is mounted on a substrate having a ground pattern provided on one surface of the insulation substrate, and is characterized in that the substrate has a pad for antenna mounting at a position distant from an edge of a ground pattern on the insulation substrate, the chip antenna is mounted so that one side having a power supply terminal provided thereat is oriented to the ground pattern side, and the other side is overlapped with the pad, and the width of the pad is twice or less of the size in the meander width direction of the meander antenna conductor. In this manner, substrate downsizing can be achieved. In addition, the pad width is set to be twice or less of the size in the meander width direction of the meander antenna conductor, whereby a wider bandwidth can be achieved even by using a small sized chip antenna.

The "size in the meander width direction" used here is equal to a distance between both ends (meander width) in the meander width direction in the case of a planar meander antenna conductor. However, this size is equal to a distance between bent sections in the case of a three-dimensional meander antenna conductor bent so that both ends in the meander width direction are close to each other, for example. The width of the pad may be 0.5 to 1.75 times of the size in the meander width direction, and more preferably, may be 1 to 1.5 times. The meander pitches are dense at the side of the power supply terminal and are coarse at the tip side. It is preferable that the antenna be mounted so that part or all of the dense portion in meander pitches is overlapped with the ground pattern.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna apparatus comprising:

a substrate;

a chip antenna mounted on the substrate; and a ground pattern disposed on a portion of a surface of the substrate, wherein an antenna conductor has a first part which overlaps the ground pattern and a second part which does not overlap the ground pattern, and the first part includes at least a portion on the side of a power supply terminal of the antenna conductor in the chip antenna.

2. The antenna apparatus according to claim 1, wherein a dense portion in meander pitches or helical pitches are provided on the power supply terminal side of the antenna conductor, and a coarse portion is provided at a tip side of the antenna conductor.

3. The antenna apparatus according to claim 1, wherein a number of turns at a dense portion in meander pitches or helical pitches is larger than a number of turns at a coarse portion.

4. The antenna apparatus according to claim 1, further comprising an antenna mount pad disposed at a position distant from an edge of the ground pattern on the substrate, wherein said chip antenna is mounted to direct one side having the power supply terminal to a side of the ground pattern, and to overlap the other side thereof with the pad, and a width of the pad is twice or less of a size in a meander width direction of a meander antenna conductor.

5. The antenna apparatus according to claim 4, wherein the width of the pad is 0.5 to 1.75 times of a size in the meander width direction of the meander antenna conductor.

6. The antenna apparatus according to claim 1, wherein the chip antenna has a meander antenna conductor;

the meander antenna conductor comprises a dense portion in meander pitches and a coarse portion in meander pitches; and part or all of the dense portion in meander pitches is mounted on the substrate to overlap the ground pattern.

7. An antenna apparatus comprising:

a chip antenna, wherein an antenna conductor has a meander shape, and said antenna conductor has a dense portion and a coarse portion in meander pitches; and a dense portion in meander pitches are provided on a power supply terminal side of the antenna conductor, and a coarse portion is provided at a tip side of the antenna conductor.

8. An antenna apparatus comprising:

a chip antenna; and an antenna mount pad disposed at a position distant from an edge of a ground pattern on a substrate, wherein said chip antenna is mounted to direct one side having a power supply terminal to a side of the ground pattern, and to overlap the other side thereof with the pad, and a width of the pad is twice or less of a size in a meander width direction of a meander antenna conductor.

9. The antenna apparatus according to claim 8, wherein a the width of the pad is 0.5 to 1.75 times of a size in the meander width direction of the meander antenna conductor.

* * * * *